United States Patent [19]

Marcantonio

[11] 4,030,254

[45] June 21, 1977

[54] SANDING SHOE WITH REMOVABLE CLAMPING JAW

[75] Inventor: Livio F. Marcantonio, Utica, N.Y.

[73] Assignee: Chicago Pneumatic Tool Company, New York, N.Y.

[22] Filed: Mar. 5, 1976

[21] Appl. No.: 664,250

[52] U.S. Cl. ..... 51/386

[51] Int. Cl.² ..... B24D 17/00

[58] Field of Search ..... 51/362, 382, 358, 383, 51/384, 385, 386, 387, 170 TL, 170 MT

[56] References Cited

UNITED STATES PATENTS

| | | | |
|---|---|---|---|
| 2,683,337 | 7/1954 | Scace | 51/384 |
| 3,183,638 | 5/1965 | Hutchins | 51/386 |
| 3,404,493 | 10/1968 | Thomas | 51/386 |
| 3,510,992 | 5/1970 | Hutchins | 51/358 X |
| 3,571,986 | 3/1971 | Champayne | 51/384 |
| 3,822,518 | 7/1974 | Sjostrand | 51/386 |
| 3,900,976 | 8/1975 | Kitts | 51/362 |
| 3,973,362 | 8/1976 | Groshans | 51/386 |

*Primary Examiner*—Al Lawrence Smith
*Assistant Examiner*—Nicholas P. Godici
*Attorney, Agent, or Firm*—Stephen J. Rudy

[57] ABSTRACT

A sanding shoe for a portable sanding tool, the sanding shoe having a flexible pad for backing a sheet of sandpaper, a flexible supporting plate moulded into the pad, and lever actuable clamping jaws removably inserted in interlocking relation with the support plate for clamping the ends of a sheet of sandpaper in place.

2 Claims, 8 Drawing Figures

SANDING SHOE WITH REMOVABLE CLAMPING JAW

BACKGROUND OF THE INVENTION

This invention is directed to improvements in a hand-held portable sanding tool of a type having a power driven reciprocable shoe carrier plate to which a sanding shoe is adapted to be bolted. More particularly, the invention is directed to the provision of an improved sanding shoe for such tools.

A feature of the improved shoe of the present invention lies in the organized arrangement of its components, and in the structure for securing a sheet of sandpaper to the shoe.

Another feature lies in the structure of the shoe, whereby the tendency of the sandpaper to tear at its ends or the area intermediately of its ends is reduced.

A further feature lies in the structure of the clamping devices for securing the ends of the sandpaper in place, whereby the clamping jaw element may be readily removed or replaced when needed.

A further feature lies in the structure of a supporting plate for the shoe and in its manner of association with the sanding pad, whereby a flexible shoe is obtained that is of particular advantage in sanding or polishing curved surfaces.

In accordance with the invention there is provided a sanding shoe for a portable sanding tool, the shoe having a flexible pad for cushioning a sheet of sandpaper extended over its underside, a flexible supporting plate moulded into the pad having means for mounting the shoe to a reciprocable carrier plate in the tool, and a pair of clamping jaws for securing opposite ends of the sandpaper in place, the clamping jaws having a removably insertable interlocking relation with the supporting plate.

DESCRIPTION OF PREFERRED EMBODIMENT OF THE INVENTION

Figure 1:
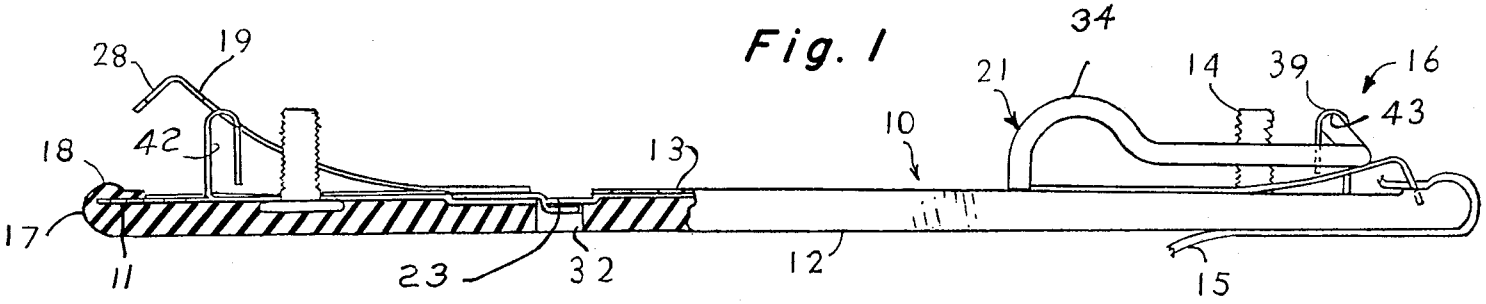
FIG. 1 is a view in side elevation of a sanding shoe, the left end being shown in section with the jaw actuating lever omitted for purposes of illustration.

In the drawing is disclosed a sanding shoe 10 of elongated rectangular form, the structure of which at one end is duplicated at the other end. It includes an elongated rectangular support plate 11 which is embedded as by moulding in an elongated rectangular pad 12. The plate is arranged so that it lies near the top of the shoe below a thin upper surface layer 13 of the pad.

A pair of threaded studs 14 fixed to the support plate, and upstanding from opposite end areas thereof, are provided for mounting the shoe, as by bolting to a reciprocable carrier plate, now shown, of a conventional sanding tool.

The pad is designed to serve as a cushioned support for an elongated rectangular sheet of sandpaper 15. The sandpaper when applied to the shoe is extended over the bottom of the pad; and its ends are extended over opposite ends of the shoe to its upper surface and then clamped in place in a pair of clamping devices 16, one located at each end of the shoe.

The pad is formed of a resilient, flexible elastomeric material. Here, it is formed of material known in the trade as Neoprene which has been found to provide good results. It is understood that other rubber-like materials can be used. So as to guard against tearing of the sandpaper in the vicinity of its ends under the customary push and pull forces developing during reciprocation of the shoe, the padding material extends a little beyond and over the ends of the support plate. This provides a rounded bulbous cushion 17 at each end to the sandpaper; and also provides a curved rib 18 extending laterally of each of the upper end surfaces of the shoe. The bulbous cushions prevent the sandpaper from being cut by the end edges of the support plate as might otherwise occur were the cushions not present.

Figure 8:
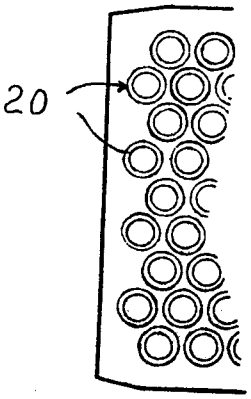
FIG. 8 is a fragmentary view of the bottom surface of a modified form of the pad provided with suction cups.
Figure 5:
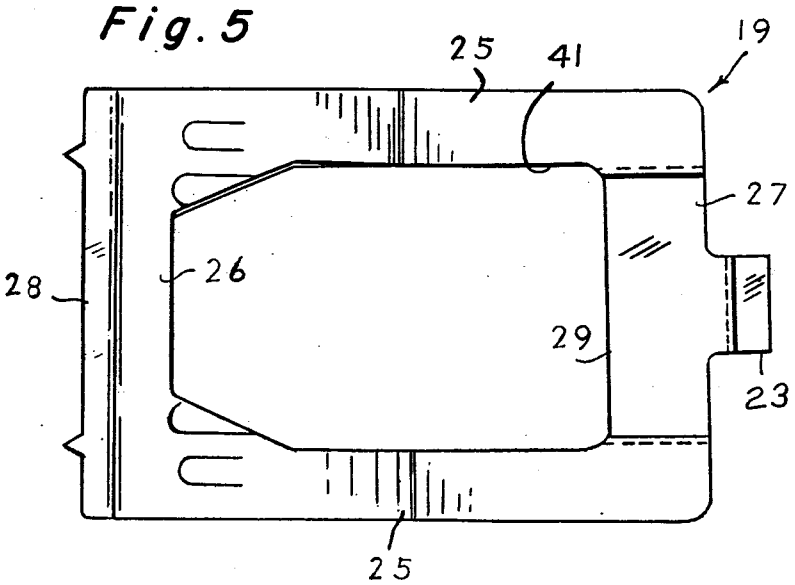
FIG. 5 is a detail in top plan of one of the clamping jaw elements.

The pad may be provided, as indicated in FIG. 8, with numerous small inwardly coned pockets 20 in its bottom surface. These pockets function under the usual downward pressure developing during operation of the tool as numerous suction cups which tend to grip the sandpaper and hold it snug against the pad. This aids in preventing side slippage and tearing of the sandpaper intermediately of its ends.

The support plate 11 is designed to have flexible characteristics. This is of particular advantage in that the support plate together with the elastomeric pad results in a flexible shoe which aids in the sanding or polishing of curved surfaces. To this end, the support plate is formed of spring tempered steel of relatively light gauge, which here is approximately .030 thick.

The clamping devices 16 are identical at each end of the shoe. Each includes a spring metal clamping jaw element 19 which is actuable by means of a camming lever 21 to and from clamping position relative to a related end of the sandpaper, an end of the sandpaper being shown in clamped position at the right in FIG. 1.

A particular advantageous feature of the jaw element is that it is insertable or detachably associated with the support plate, whereby it may be readily replaced when needed. This avoids the undesirable aspect associated with a type of sanding shoe in which the jaw element is riveted in place. In the latter situation there would be a tendency of the user to discard the entire shoe when the jaw element has deteriorated.

Figure 2:
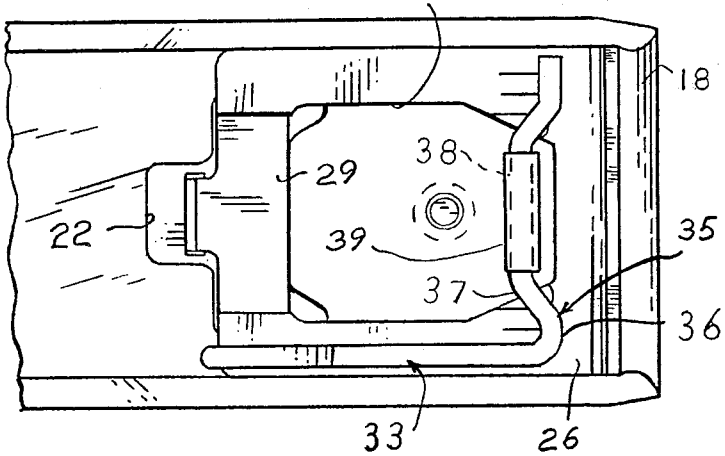
FIG. 2 is a top plan view of one of the ends of the sanding shoe shown in FIG. 1.

The jaw element is designed to seat at its rear end in a depression or recess 22 pressed into the surface of the support plate; and it is provided with a tail piece 23 which is adapted to be inserted in a slot 24 of the support plate in interlocking relation with the latter, as best seen in FIG. 1 at the left. The depression 22 formed in the support plate includes a rear extension 31 in which the slot 24 is formed. The depression is exposed through the upper layer of the elastomeric pad, as indicated in FIG. 2.

Figure 7:
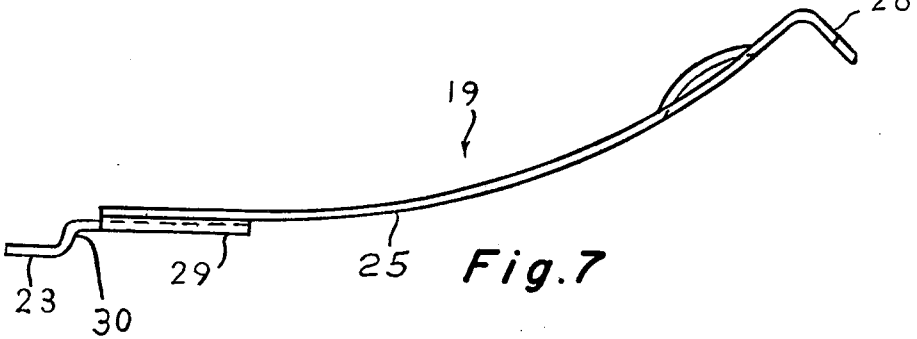
FIG. 7 is a view in side elevation of the clamping jaw element shown in FIG. 5, but drawn to a larger scale for clarity of illustration.

In more detail, the jaw element 19 is formed of thin gauge flat or leaf spring steel. It is of a general rectangular form curved in its mid-area. It has a pair of parallel longitudinally extending flat side strips or legs 25 which are integrally joined at their forward and rear ends by bridging or laterally extending cross-strips 26, 27. The forward bridge strip 26 is flanged or offset downwardly along its forward end to define a toothed jaw 28. The rear bridge strip 27 is depressed between the ends of the legs to provide a bottom or downward protrusion 29 adapted to seat in the recess 22 formed in the surface of the support plate. The tail piece 23, which is stepped downwardly as by a flange or step 30, extends rearwardly in a plane at a lower level than the bottom 29. And the leg portions 25 are inherently tensioned angularly so as to curve upwardly from the rear bridgestrip, as best indicated in FIGS. 1 and 7.

To assemble the jaw element 19 to the support plate 11, its tail piece 23 is inserted through the lateral slot 24 formed in an extension 31 of the recess 22 of the support plate. The jaw element is then angularly lowered to seat its bottom 29 in the recess. When this occurs, the tail piece 23 will abut against the undersurface of the depressed portion 31 of the support plate, and the depressed portion 29 will be substantially flush with the surface of the support plate or a little below the surface of the shoe, as seen in FIG. 1. A recess 32 is provided in pad 12 to accommodate the tail piece.

Figure 3:
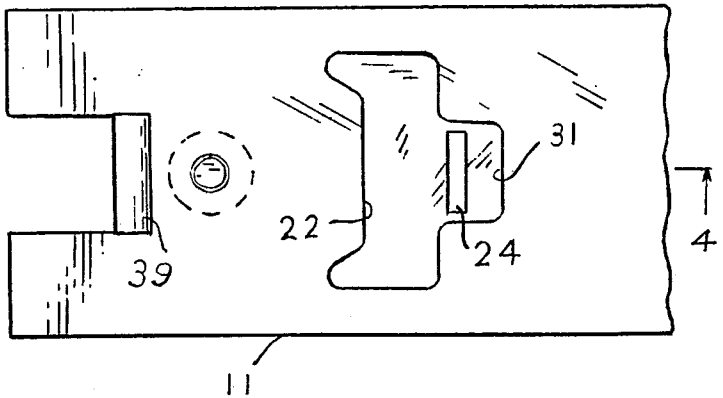
FIG. 3 is a plan view of one end of the supporting plate.
Figure 4:
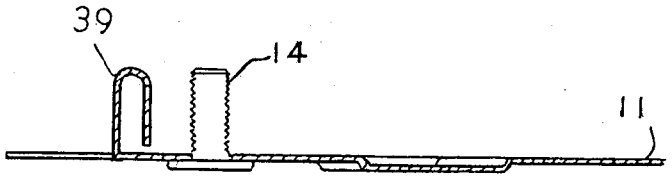
FIG. 4 is a section taken on line 4—4 of FIG. 3.
Figure 6:
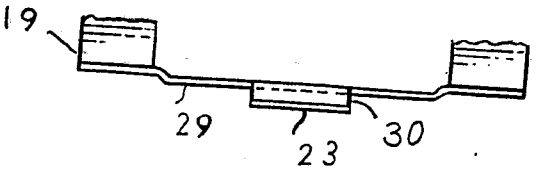
FIG. 6 is a fragmentary section of FIG. 5 looking from the right end of the latter.

The camming lever 21 is of L-form and of the overcenter type. It includes a manipulative power arm section 33 having at its rear a finger grip 34. Offset laterally from the forward end of the power arm is a camming arm section, generally indicated 35. The latter includes, as best seen in FIG. 2, a pair of laterally spaced end cam portions 36 disposed at right angles to the power arm. The cam portions overlie the surface area of the forward bridge piece 26 of the jaw member. A pair of short sections 37 inclined or converging toward each other slope upwardly and rearwardly from the inner ends of the cam portions 36, and are bridged by a central pivot section 38. The latter extends parallel to the cam portions and serves as a pivot or journal for the lever. The journal is disposed in a bearing 39 which is integral with and cut out of the support plate. In this latter respect, after a pair of parallel cuts have been made into an end of the support plate, the resultant tab is bent upwardly, then over at a radius, and then downwardly to form the bearing 39 (FIG. 3). The resultant bearing is located, as indicated in FIG. 2, within the space 41 between the leg portions of the jaw element so as not to interfere with angular movement of the latter. An inherent upward bias of the upwardly tensioned spring legs of the jaw element serves to maintain the journal portion 38 of the lever in contact with a bearing surface 43 at the upper end of the bearing element. This tensioned abutting relation of the jaw element with the lever also serves to maintain the jaw element in its seated and interlocked relation with the support plate. It is apparent that the lever 21 may be readily inserted into or slipped laterally out of the space 42 defined between the forward and rear panels of the bearing element, by merely depressing the jaw element angularly downward as needed.

It can be seen that when the lever is pivoted from a forward position, not shown, to the clamping position shown in FIGS. 1, 2, its cam portions 36 will force the jaw end 26, 28 downwardly into clamping relation with the sandpaper. The toothed jaw 28 is designed to engage the sandpaper at the inner end of the base of the curved rib 18 so as to not only grip the sandpaper in its teeth but also to wedge it firmly between the rib and the forward face of the jaw end 28.

It is to be noted that the bearing element 39 rises sufficiently above the surface of the shoe to enable the camming arm section 35 of the lever to be slipped endwise into or out of the space 42 defined between the forward and rear panels of the bearing element. Accordingly it can be seen that, when it is required that a clamping jaw element be replaced, the operator will manually depress the clamping jaw element downwardly to relieve its tension from the lever. The lever is then slipped free of the bearing element. This permits the jaw element to be drawn free of its interlocking relation with the support plate. The procedure is reversed in replacing the jaw element.

I claim:

1. A sanding shoe comprising an elongated spring metal support plate adapted for bolting to a reciprocable carrier plate in a portable sanding tool, an elongated rectangular elastomeric pad in which the support plate is moulded, the pad providing a cushion backing for a sheet of sandpaper extended over its bottom surface, separate clamping means detachably mounted upon opposite upper end areas of the shoe for clamping in place opposite ends of the sandpaper extending over corresponding ends of the shoe, the support plate and the pad being flexible as a unit in moving over curved surfaces during operation of the tool, each of said clamping means including a spring metal flexible clamping jaw element having a rear end removably interlocked with the support plate and having a jaw end inherently biased angularly upward from the shoe in an open condition, a bearing element integral with the support plate and extending upwardly therefrom above the surface of the shoe, and a manipulative lever pivotable in the bearing and having a camming arm in overlying relation to the jaw end of the clamping jaw element, said support plate including a slot, the clamping jaw element including a tailpiece at its rear end insertable into the slot, said jaw end of the clamping jaw element being inherently biased upwardly against the camming arm of the lever.

2. A sanding shoe as in claim 1, wherein the support plate has a recessed area in its surface, and the clamping jaw element has a depressed rear portion adjacent its tail piece seated in the recessed area.

* * * * *